US008544710B2

(12) United States Patent
Tanaka

(10) Patent No.: US 8,544,710 B2
(45) Date of Patent: Oct. 1, 2013

(54) GAS COMBUSTION TYPE DRIVING TOOL

(75) Inventor: Hiroshi Tanaka, Chuo-ku (JP)

(73) Assignee: Max Co., Ltd., Tokyo (JP)

( * ) Notice: Subject to any disclaimer, the term of this patent is extended or adjusted under 35 U.S.C. 154(b) by 455 days.

(21) Appl. No.: 12/738,435

(22) PCT Filed: Oct. 16, 2008

(86) PCT No.: PCT/JP2008/068781

§ 371 (c)(1),
(2), (4) Date: Apr. 16, 2010

(87) PCT Pub. No.: WO2009/051195

PCT Pub. Date: Apr. 23, 2009

(65) Prior Publication Data

US 2010/0230461 A1 Sep. 16, 2010

(30) Foreign Application Priority Data

Oct. 17, 2007 (JP) ..... 2007-270396

(51) Int. Cl.

| | |
|---|---|
| ***B25C 1/12*** | (2006.01) |
| ***B25C 1/14*** | (2006.01) |
| ***B25C 1/04*** | (2006.01) |
| ***B25C 5/02*** | (2006.01) |
| ***B25C 5/06*** | (2006.01) |
| ***B25C 1/00*** | (2006.01) |
| ***B27F 7/00*** | (2006.01) |

(52) U.S. Cl.
USPC ..... 227/10; 227/130; 227/131; 227/113

(58) Field of Classification Search
USPC ..... 173/162.2, 217; 227/10, 130–131; 123/472, 530–533, 585
See application file for complete search history.

(56) References Cited

U.S. PATENT DOCUMENTS

| | | | | |
|---|---|---|---|---|
| 3,628,631 | A * | 12/1971 | O'Leary | 184/55.2 |
| 3,638,738 | A * | 2/1972 | Varnell | 173/90 |
| 4,014,169 | A * | 3/1977 | Umino | 60/290 |
| 4,176,638 | A * | 12/1979 | Kitamura et al. | 477/111 |
| 4,205,636 | A * | 6/1980 | Kimata et al. | 123/455 |
| 4,216,938 | A * | 8/1980 | Inada et al. | 251/65 |
| 4,237,836 | A * | 12/1980 | Tanasawa et al. | 123/472 |
| 4,303,048 | A * | 12/1981 | Nishio | 123/339.24 |
| 4,354,464 | A * | 10/1982 | Fujita | 123/323 |
| 4,460,126 | A * | 7/1984 | Gates et al. | 239/112 |

(Continued)

FOREIGN PATENT DOCUMENTS

| | | |
|---|---|---|
| JP | 9-174456 | 7/1997 |
| JP | 10-225875 | 8/1998 |

(Continued)

*Primary Examiner* — Robert Long
(74) *Attorney, Agent, or Firm* — Drinker Biddle & Reath LLP

(57) ABSTRACT

In a gas combustion type driving tool, a measuring chamber 22 is provided in an intermediate part of a gas pipeline 11 between a gas canister 7 and a combustion chamber 2. A solenoid valve 23 is provided in the measuring chamber 22. When fuel gas is supplied to the combustion chamber, an upstream side gas pipeline 11*a* and a downstream side gas pipeline 11*b* of the measuring chamber 22 are opened for a predetermined opening time by the solenoid valve 23 to supply the fuel gas within the measuring chamber 22 to the gas pipeline 11*b* by an injection pressure of the fuel gas in the gas canister 7.

3 Claims, 8 Drawing Sheets

(56) References Cited

U.S. PATENT DOCUMENTS

| | | | | | |
|---|---|---|---|---|---|
| 4,483,474 | A | * | 11/1984 | Nikolich | 227/8 |
| 4,658,231 | A | * | 4/1987 | Schwenzer et al. | 335/261 |
| 4,841,942 | A | * | 6/1989 | McKay | 123/533 |
| 5,024,202 | A | * | 6/1991 | McKay | 123/533 |
| 5,115,944 | A | * | 5/1992 | Nikolich | 222/94 |
| 5,133,329 | A | * | 7/1992 | Rodseth et al. | 123/630 |
| 5,170,766 | A | * | 12/1992 | Haas et al. | 123/531 |
| 5,193,782 | A | * | 3/1993 | Bailey | 251/129.21 |
| 5,211,558 | A | * | 5/1993 | Bailey et al. | 433/77 |
| 5,261,447 | A | * | 11/1993 | Boticki | 137/493.2 |
| 5,263,439 | A | * | 11/1993 | Doherty et al. | 123/46 SC |
| 5,377,578 | A | * | 1/1995 | Borries | 91/47 |
| 5,524,713 | A | * | 6/1996 | Lange | 173/2 |
| 5,526,796 | A | * | 6/1996 | Thring et al. | 123/531 |
| 5,660,238 | A | * | 8/1997 | Earl et al. | 175/40 |
| 5,680,980 | A | | 10/1997 | Robinson | |
| 5,909,836 | A | | 6/1999 | Shkolnikov et al. | |
| 5,967,413 | A | * | 10/1999 | Tian | 239/88 |
| 5,971,245 | A | | 10/1999 | Robinson | |
| 5,988,477 | A | | 11/1999 | Deieso et al. | |
| 5,993,412 | A | * | 11/1999 | Deily et al. | 604/68 |
| 6,004,127 | A | * | 12/1999 | Heimberg et al. | 431/179 |
| 6,145,724 | A | | 11/2000 | Shkolnikov et al. | |
| 6,164,510 | A | | 12/2000 | Deieso et al. | |
| 6,311,887 | B1 | * | 11/2001 | Walter | 227/10 |
| 6,463,894 | B2 | * | 10/2002 | Hasler et al. | 123/46 R |
| 6,520,397 | B1 | * | 2/2003 | Moeller | 227/130 |
| 6,634,325 | B1 | * | 10/2003 | Adams | 123/46 R |
| 6,783,045 | B2 | * | 8/2004 | Shima et al. | 227/8 |
| 6,877,679 | B2 | * | 4/2005 | Lawes | 239/585.1 |
| 6,974,063 | B2 | * | 12/2005 | Schiestl et al. | 227/9 |
| 7,040,520 | B2 | * | 5/2006 | Turk | 227/10 |
| 7,108,164 | B2 | * | 9/2006 | Shima et al. | 227/8 |
| 7,150,139 | B1 | * | 12/2006 | Lund et al. | 56/10.8 |
| 7,396,090 | B2 | * | 7/2008 | Krawczyk et al. | 303/119.2 |
| 7,427,007 | B2 | * | 9/2008 | Shima et al. | 227/8 |
| 7,484,648 | B2 | * | 2/2009 | Gschwend et al. | 227/10 |
| 7,594,599 | B2 | * | 9/2009 | Webb | 227/10 |
| 7,712,547 | B2 | * | 5/2010 | Ikuta et al. | 173/162.1 |
| 7,775,040 | B2 | * | 8/2010 | Khalil | 60/419 |
| 8,083,144 | B2 | * | 12/2011 | Calvet et al. | 235/451 |
| 2002/0104893 | A1 | * | 8/2002 | Kimmel et al. | 239/5 |
| 2004/0026476 | A1 | * | 2/2004 | Shima et al. | 227/10 |
| 2005/0039804 | A1 | * | 2/2005 | kim | 137/625.48 |
| 2006/0032886 | A1 | * | 2/2006 | Gschwend et al. | 227/10 |
| 2007/0044779 | A1 | * | 3/2007 | Green | 123/585 |
| 2008/0217372 | A1 | * | 9/2008 | Webb | 227/10 |
| 2009/0000801 | A1 | * | 1/2009 | Calvet et al. | 173/210 |
| 2011/0180582 | A1 | * | 7/2011 | Cordeiro et al. | 227/9 |

FOREIGN PATENT DOCUMENTS

| | | | |
|---|---|---|---|
| JP | 2956004 | | 7/1999 |
| JP | 11-216684 | | 8/1999 |
| JP | 2000-354979 | | 12/2000 |
| JP | 2005-144608 | | 6/2005 |
| WO | WO 2007004025 | A1 * | 1/2007 |
| WO | WO 2007004029 | A1 * | 1/2007 |

* cited by examiner

GAS COMBUSTION TYPE DRIVING TOOL

TECHNICAL FIELD

The present invention relates to a gas combustion type driving tool that supplies fuel gas from a gas canister attached in a tool main body to a combustion chamber.

BACKGROUND ART

Generally, in a gas combustion type driving tool, a gas canister is connected to a combustion chamber by a gas pipeline. During a striking operation, fuel gas filled within the gas canister is jetted and supplied by a predetermined quantity to the combustion chamber in a sealed state. The fuel gas is mixed with air in the combustion chamber to obtain mixed gas. The mixed gas is ignited by an ignition plug and explosively burnt. A striking piston in a striking cylinder is driven by a combustion pressure and a fastener is driven from a nose part provided in a lower part of the tool main body by a driver integrally connected to the striking piston.

In the driving tool main body, a measuring chamber for storing the predetermined quantity of the fuel gas is arranged in a vicinity of an injection port of the fuel gas of the gas canister. In an outlet of the measuring chamber, an injection valve is provided. Ordinarily, the gas jetted from the gas canister is stored in the measuring chamber to shut off the injection port of the fuel gas by the injection valve. During the striking operation, the gas pipeline is opened to the combustion chamber (is shut off relative to the gas canister) by the injection valve interlocking with an operation of a trigger to supply the fuel gas in the measuring chamber to the combustion chamber from the gas pipeline. At this time, the injection valve simultaneously shuts off the gas canister and the measuring chamber so as not to supply the fuel gas in the gas canister to the measuring chamber (see Patent Document 1).
Patent Document 1: JP-B2-2956004

The gas canister to be used has a double structure including an inner vessel filled with the fuel gas and an outer vessel filled with propellant gas whose internal pressure is higher by 2 to 3 atmospheric pressure than an internal pressure of the inner vessel. The inner vessel is pressed by the gas pressure of the propellant gas to jet the fuel gas. In this structure, the pressure of the propellant gas operates when the injection valve closes the gas pipeline to the combustion chamber and opens to the gas canister. During the jet of the fuel, when the injection valve shuts off a part between the measuring chamber and the inner part of the gas canister as described above, the pressure of the propellant gas does not operate. Accordingly, the fuel gas is supplied to the combustion chamber only by a vaporizing pressure of the fuel gas from the measuring chamber.

However, when the vaporizing pressure of the fuel gas is lowered, for instance, when the fuel gas is used under a low temperature environment, it takes much time for the fuel gas in the measuring chamber to enter the combustion chamber or a part of the fuel gas remains in the measuring chamber. Therefore, there is a fear that the fuel gas may not be ignited or cannot be ignited when a predetermined time does not elapse.

SUMMARY OF INVENTION

One or more exemplary embodiments of the present invention provide a gas combustion type driving tool that can stably and assuredly supply fuel gas to a combustion chamber by applying a pressure to the fuel gas even after a gas pipeline of the fuel gas from a measuring chamber to the combustion chamber.

According to a first aspect of the present invention, a gas combustion type driving tool, in which fuel gas is supplied to a combustion chamber to ignite mixed gas obtained by agitating and mixing the fuel gas with air and a striking mechanism is driven by a combustion pressure to drive a fastener, is provided with a measuring chamber provided in an intermediate part of a gas pipeline between a gas canister and the combustion chamber and a solenoid valve provided in the measuring chamber. When the fuel gas is supplied to the combustion chamber, upstream and downstream side gas pipelines of the measuring chamber are opened for a predetermined opening time by the solenoid valve to supply the fuel gas in the measuring chamber to the combustion chamber by the injection pressure of the fuel gas in the gas canister.

Further, according to a second aspect of the present invention, a gas combustion type driving tool, in which fuel gas is supplied to a combustion chamber to ignite mixed gas obtained by agitating and mixing the fuel gas with air and a striking mechanism is driven by a combustion pressure to drive a fastener, is provided with a measuring chamber provided in an intermediate part of a gas pipeline between a gas canister and the combustion chamber; a solenoid valve provided in the measuring chamber to open and close the gas pipeline and an air supply device connected to the measuring chamber. When the fuel gas is supplied to the combustion chamber, the downstream side gas pipeline is opened and the upstream side gas pipeline is closed at the same time by the solenoid valve and compressed air is supplied to the measuring chamber from the air supply device to supply the fuel gas in the measuring chamber to the combustion chamber.

According to a third aspect of the present invention, a gas combustion type driving tool is provided with a gas pipeline provided between a gas canister and a combustion chamber and having an upstream side gas pipeline and a downstream side gas pipeline; a measuring chamber provided between the upstream side gas pipeline and the downstream side gas pipeline; a solenoid valve provided in the measuring chamber; and an air supply device connected to the downstream side gas pipeline. When fuel gas is supplied to the combustion chamber, the downstream side gas pipeline is opened and the upstream side gas pipeline is closed at the same time by the solenoid valve and compressed air is supplied to the downstream side gas pipeline from the air supply device to supply the fuel gas to the combustion chamber.

According to a fourth aspect of the present invention, in the gas combustion type driving tool according to the second or third aspect of the invention, the air supply device supplies the air interlocking with a contact member that is pushed in and relatively moved by pressing an end of a driving tool main body to a workpiece.

In the gas combustion type driving tool according to the first aspect of the invention, the solenoid valve is provided in the measuring chamber provided in the intermediate part of the gas pipeline between the gas canister and the combustion chamber, and when the fuel gas is supplied to the combustion chamber, the upstream and downstream side gas pipelines are opened for a predetermined opening time by the solenoid valve to supply the fuel gas in the measuring chamber to the combustion chamber by the injection pressure of the fuel gas in the gas canister. Thus, while the gas pipelines are opened, the fuel gas in the measuring chamber is powerfully jetted to the combustion chamber by the injection pressure of the fuel gas in the gas canister. Further, the quantity of the fuel gas to be supplied to the combustion chamber is determined in accordance with an opening time of the solenoid valve. Accordingly, the fuel gas can be stably and assuredly supplied to the combustion chamber.

In the gas combustion type driving tool according to the second aspect of the invention, the measuring chamber is provided in the intermediate part of the gas pipeline between the gas canister and the combustion chamber, the solenoid valve is provided in the measuring chamber to open and close the gas pipeline and the measuring chamber is connected to the air supply device. When the fuel gas is supplied to the combustion chamber, the downstream side gas pipeline is opened and the upstream side gas pipeline is closed at the same time by the solenoid valve and compressed air is supplied to the measuring chamber from the air supply device to supply the fuel gas in the measuring chamber to the combustion chamber. Thus, when the downstream side gas pipeline is opened, the compressed air is supplied to the measuring chamber from the air supply device, so that the air pressure of the compressed air is applied to powerfully jet the fuel gas in the measuring chamber to the combustion chamber. Accordingly, the fuel gas can be stably and assuredly supplied to the combustion chamber.

In the gas combustion type driving tool according to the third aspect of the invention, since the air supply device is connected to the intermediate part of the downstream side gas pipeline communicating with the combustion chamber, the fuel gas in the measuring chamber is supplied to the part of the gas pipeline connected to the air supply device by the vaporizing pressure. Then, after the predetermined quantity of fuel gas is supplied, when the valve main body closes the gas pipeline, the air supply device is operated to supply the compressed air to the air pipeline. Accordingly, the fuel gas can be stably and assuredly supplied to the combustion chamber 2.

In the gas combustion type driving tool according to the fourth aspect of the invention, since the air supply device supplies the air interlocking with the contact member that is pushed in and relatively moved by pressing an end of the driving tool main body to the workpiece, the air supply device can be automatically operated without using an electric unit.

Other aspects and advantages of the invention will be apparent from the following description, the drawings and the claims.

DESCRIPTION OF REFERENCE NUMERALS AND SIGNS

2 . . . combustion chamber
7 . . . gas canister
11 . . . gas pipeline
22 . . . measuring chamber
23 . . . solenoid valve

BEST MODE FOR CARRYING OUT THE INVENTION

A gas combustion type driving tool according to exemplary embodiments of the present invention will be described below by way of a nailing machine.

First Exemplary Embodiment

Figure 1:
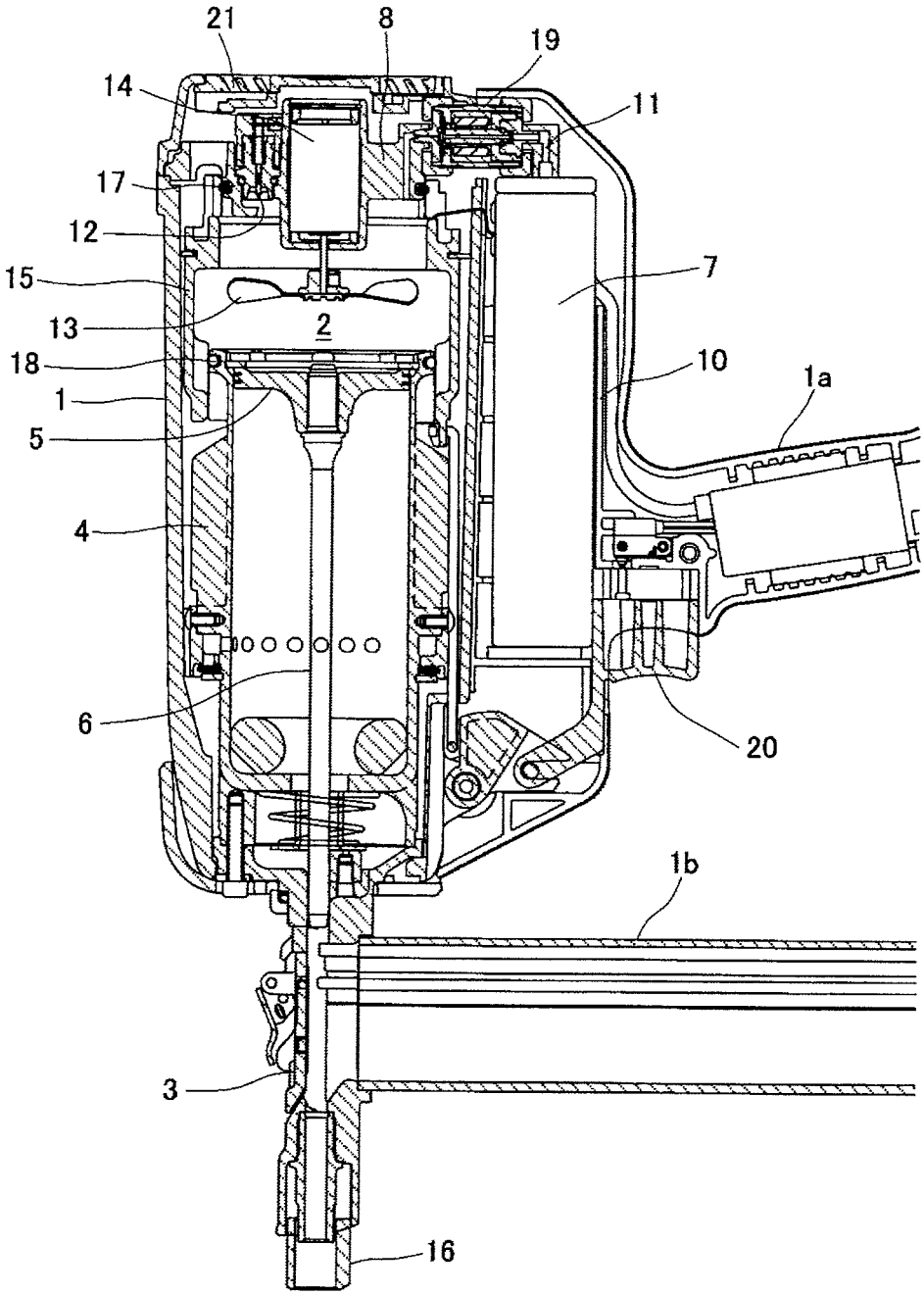
FIG. 1 is a longitudinally sectional view showing main parts of a gas combustion type nailing machine according to a first exemplary embodiment of the present invention.
Figure 2:
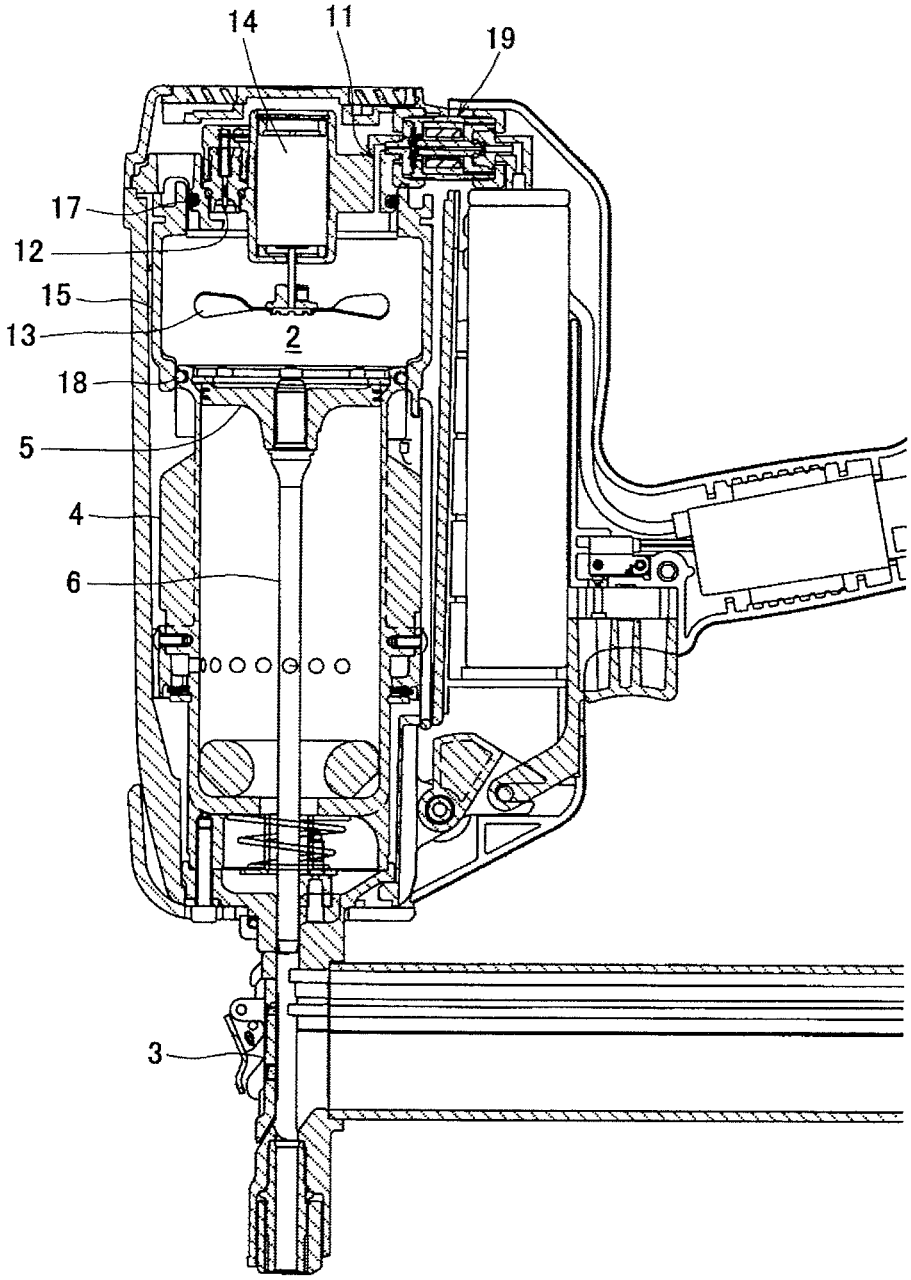
FIG. 2 is a longitudinally sectional view of main parts showing a state that a combustion chamber is closed.

In FIGS. 1 and 2, reference numeral 1 designates a tool main body of a gas combustion type driving tool (a nailing machine). In the tool main body 1, a grip 1*a* and a magazine 1*b* are continuously provided and a combustion chamber 2 and a striking piston and cylinder mechanism are provided therein. In a lower part of the tool main body 1, a nose part 3 for driving nails is provided.

The striking piston and cylinder mechanism accommodates a striking piston 5 in a striking cylinder 4 so as to freely slide and a driver 6 is integrally connected to a lower part of the striking piston 5.

In a cylinder head part 8, an ignition plug 12 and a rotating fan 13 are provided. The ignition plug 12 serves to ignite and burn the mixed gas of fuel gas and air in the combustion chamber 2. The rotating fan 13 serves to agitate and mix the fuel gas and the air and is arranged in a center of a movable sleeve 15. Reference numeral 14 designates a motor for driving the rotating fan 13.

Further, in the tool main body 1, an accommodating part 10 of a gas canister 7 is formed in a rear part of the striking cylinder 4. To the cylinder head part 8, a gas pipeline 11 of the fuel gas for connecting the gas canister 7 to the combustion chamber 2 is opened. The gas canister 7 has a double structure including an inner vessel filled with liquefied fuel gas and an outer vessel filled with propellant gas whose internal pressure is higher by 2 to 3 atmospheric pressure than an internal pressure of the inner vessel. The inner vessel is pressed by the gas pressure of the propellant gas to jet the fuel gas.

In an upper part of an outer side of the striking cylinder 4, the movable sleeve 15 forming the combustion chamber 2 is arranged. The movable sleeve 15 is formed in a cylindrical configuration and is arranged so as to vertically slide between the striking cylinder 4 and the cylinder head part 8 formed in an inner part of an upper housing. Then, as shown in FIG. 1, when the movable sleeve moves downward, the combustion chamber 2 formed in the movable sleeve 15 is opened. As shown in FIG. 2, when the movable sleeve moves upward, the closed combustion chamber 2 is formed in the movable sleeve 15.

The movable sleeve 15 is formed with a tubular member so as to have a diameter larger than that of the striking cylinder 14. A lower end of the movable sleeve is extended to a part lower than an opening end of an upper part of the striking cylinder 4. The movable sleeve 15 is connected to a contact member 16 provided at the end of the nose part 3 so as to freely slide through a link member not shown in the drawing. The contact member 16 is urged to protrude from the end of the nose part 3 by a spring. When the nose part 3 is pressed to a workpiece, since the contact member 16 is pushed in and moved upward, the movable sleeve 15 is also moved upward through the link member so that the closed combustion chamber 2 is formed as shown in FIG. 2. On the contrary, when the nose part 3 is separated from the workpiece, since the contact member 16 moves to an original position, the movable sleeve 15 is also moved downward to open the combustion chamber 2.

Now, an operating state of the nailing machine of the above-described structure will be described below. Initially, in driving a nail, when the nose part 3 is strongly pressed to the workpiece in a lower part and moved upward relatively to the tool main body 1, the movable sleeve 15 is moved upward together with the contact member 16 interlocking with the above-described operation. As a result, as shown in FIG. 2, the combustion chamber 2 is formed that is sealed by an upper O-ring 17 provided in the cylinder head part 8 and a lower O-ring 18 provided in an outer periphery of an upper end of the striking cylinder 4. The fuel gas is jetted to the combustion chamber 2 from the gas pipeline 11. The rotating fan 13 is rotated by the motor 14 to agitate and mix combustible gas and the air. Then, when a trigger 20 is pulled to ignite the ignition plug 12, the mixed gas is explosively burnt. Thus, the striking piston 5 is driven to drive the nails supplied to the nose part 3.

On the other hand, when the striking piston 5 is returned and the contact member is separated from the workpiece after the driving operation is finished, the movable sleeve 15 is moved downward as shown in FIG. 1 and a sealed state by the upper O-ring 17 and the lower O-ring 18 is released to open the combustion chamber 2. Fresh air enters from an upper opening groove 21 to prepare for a next driving operation.

Figure 3:
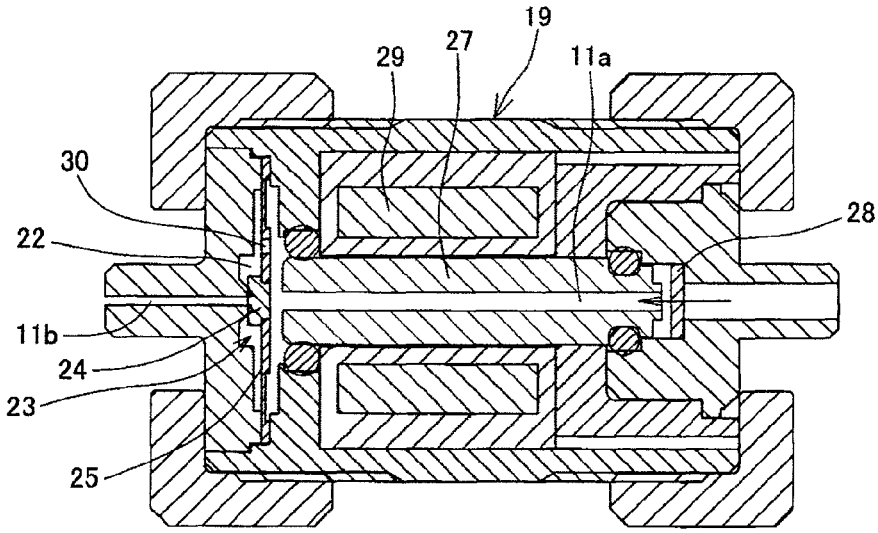
FIG. 3 is a sectional view showing a measuring chamber and a solenoid valve of a fuel supply valve.
Figure 4:
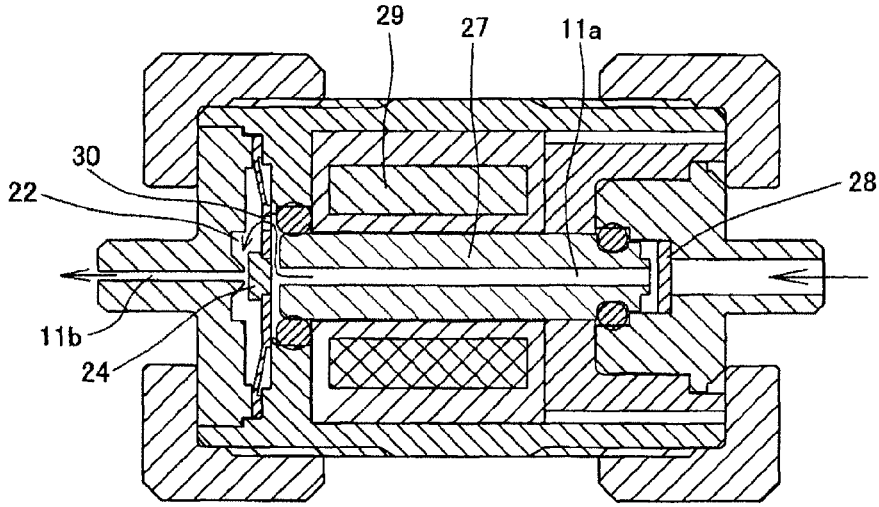
FIG. 4 is an explanatory view of an operating state of the solenoid valve.

As specifically shown in FIG. 3, in an intermediate part in the gas pipeline 11 between the gas canister 7 and the combustion chamber 2, a fuel supply valve 19 is arranged. In the fuel supply valve 19, a measuring chamber 22 is provided and a solenoid valve 23 is provided in the measuring chamber 22. Namely, a valve main body 24 is arranged in a central part of the measuring chamber 22. The valve main body 24 is urged to close an opening end of a downstream side of the gas pipeline 11 (an opening end of a downstream side gas pipeline 11*b*) from the measuring chamber 22 by a support plate 25 made of elastic metal. An upstream side gas pipeline 11*a* of the gas pipeline 11 in the upstream side of the measuring chamber 22 is formed with an iron core 27 and a coil 29 is wound on the periphery of the iron core 27. In the support plate 25, a through hole 30 is formed. Thus, when an electric current is supplied to the coil 29, as shown in FIG. 4, the support plate 25 is attracted to the iron core so that the valve main body 24 opens the opening end of the downstream side gas pipeline 11*b* to jet the fuel gas in the measuring chamber 22 to the combustion chamber 2 from the gas canister 7 by vaporizing pressure. The valve main body 24 stops at a position where the opening end of the gas pipeline 11*a* of the iron core 27 is not shut off to allow the upstream gas pipeline 11*a* to communicate with the downstream side gas pipeline 11*b*. Reference numeral 28 designates a filter 28.

When a nailing operation is carried out, the tool main body 1 is pressed to the workpiece to push the contact member 16 into the tool main body 1, the electric current is supplied to the coil 29 interlocking with the operation.

Accordingly, in the nailing operation, when the electric current is supplied to the coil 29 to open and operate the valve main body 24, since not only the fuel gas in the measuring chamber 22, but also the fuel gas in the upstream side gas pipeline 11*a* is jetted through the through hole 30 of the support plate 25, the fuel gas in the measuring chamber 22 is powerfully jetted by the injection pressure of the fuel gas in the gas canister 7 while the downstream gas pipeline 11*b* is opened.

The quantity of the fuel gas at this time is determined in accordance with the opening time of the valve main body 24. Since the flow rate of the fuel gas flowing in the gas pipeline 11*b* during a predetermined time is fixed, the opening time of the valve main body 24 is adjusted so that the quantity of the fuel gas jetted to the combustion chamber 2 may be controlled.

When air temperature is low, the flow rate of the fuel gas is lowered. In this case, the opening time of the valve main body 24 may be mechanically or electrically adjusted. For instance, the opening time may be adjusted by an adjusting lever (an adjusting part for setting the opening time) (not shown in the drawing). When the air temperature is low, a driving force is insufficient and a driving depth of a nail is not sufficient, the opening time may be increased by the adjusting lever. When the opening time of the valve main body is electrically controlled, a relation between the air temperature and the flow rate may be previously provided in a table to adjust a time for supplying an electric current to the coil 29 correspondingly to an actual outside air temperature.

Second Exemplary Embodiment

Figure 5:
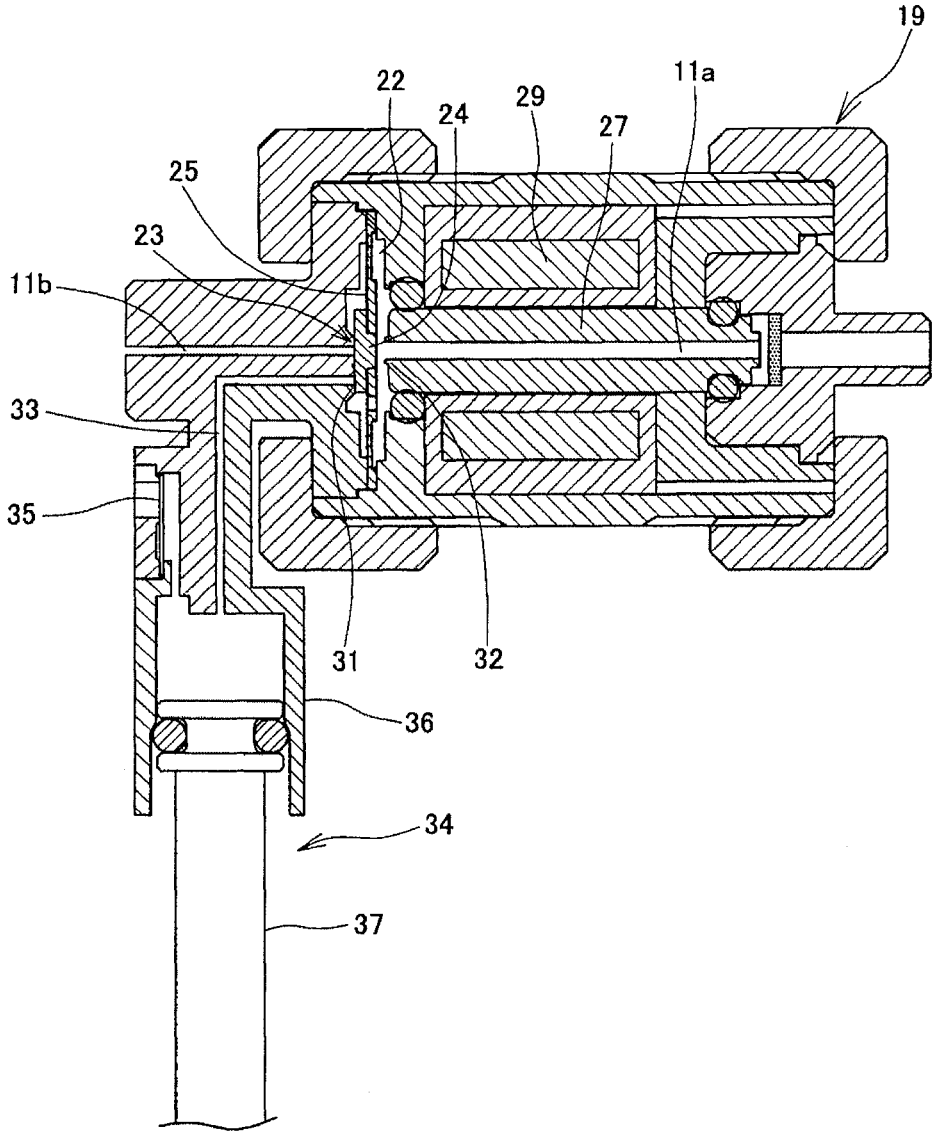
FIG. 5 is a sectional view of a fuel supply valve in a second exemplary embodiment.

FIG. 5 shows a second exemplary embodiment. In the second exemplary embodiment, the structures of gas pipelines 11*a* and 11*b*, a measuring chamber 22, an iron core 27 and a coil 29 are the same as those of the first exemplary embodiment. In the second exemplary embodiment, when the supply of an electric current to the coil 29 is released, a support plate 25 made of metal for holding a valve main body 24 is separated from an opening end 32 of the upstream side gas pipeline 11*a* to open the opening end of the upstream side gas pipeline 11*a* and shuts off an opening end 31 of the downstream side pipeline 11*b*.

Further, the measuring chamber 22 is connected to an air plunger (an air supply device) 34 through an air pipeline 33. The air plunger 34 includes a plunger 37 in a syringe 36 having an opening and closing valve 35 so as to freely slide. When the plunger 37 is moved forward, air in the syringe 36 is compressed and supplied under pressure to the measuring chamber 22 through the air pipeline 33. When the plunger 37 is moved backward, the opening and closing valve 35 is opened to introduce air to the syringe 36. When a tool main body 1 is pressed downward to a workpiece so that a contact member 16 is relatively moved upward and pushed in the tool main body 1, the plunger 37 is mechanically or electrically operated interlocking with the above-described operation.

When the plunger is mechanically operated, an end part of the plunger 37 is connected to an upper end of an operating member (not shown in the drawing) that operates upward and downward integrally with the contact member 16 shown in FIG. 1. When the tool main body 1 is pressed downward to the workpiece during a driving operation of a nail so that the operating member is moved upward together with the contact member 16, the plunger 37 is moved upward interlocking therewith and pushed in the syringe 36 to supply the air therein under pressure. After the nail is driven, when the operating member is moved downward together with the contact member 16, the plunger 37 is pulled downward interlocking therewith to take in the air in the syringe 36 and prepare for a next supply of air under pressure.

When the plunger is electrically operated, the plunger may be moved upward or downward by using a solenoid or a motor.

A solenoid valve 23 is formed so as to open and close an opening end of the air pipeline 33.

The electric current is supplied to the coil 29 when the tool main body 1 is pressed to the workpiece, in driving the nail, to push the contact member 16 into the tool main body 1.

Figure 6:
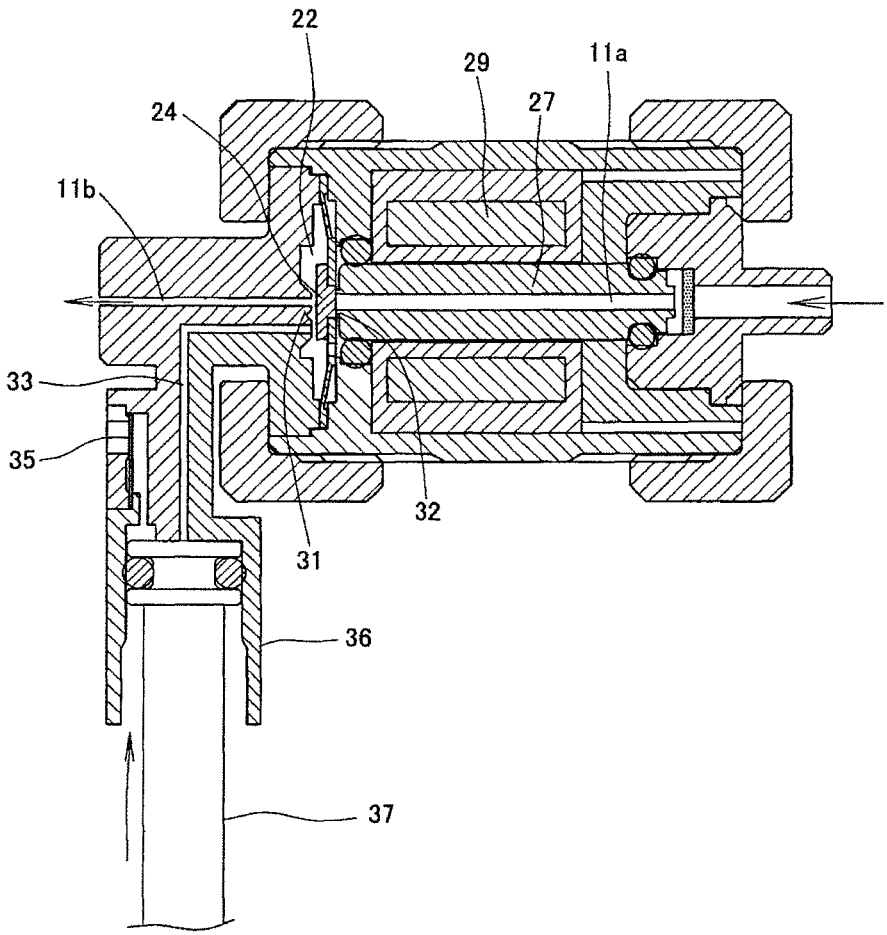
FIG. 6 is a explanatory view of an operating state of the fuel supply valve.

Accordingly, when the electric current is supplied to the coil 29, during the nail driving operation, to operate the valve main body 24, as shown in FIG. 6, the downstream side gas pipeline 11*b* and the air pipeline 33 are opened and the upstream side gas pipeline 11*a* is closed. Fuel gas in the measuring chamber 22 is supplied to a combustion chamber 2 through the downstream side gas pipeline 11*b* by a vaporizing pressure. At the same time, the air plunger 34 is operated to compress the air in the syringe 36 and supply the air to the measuring chamber 22 through the air pipelined 33. Therefore, since air pressure is applied to the fuel gas in the measuring chamber 22, the fuel gas in the measuring chamber 22 is powerfully jetted to the combustion chamber 2. Accordingly, the fuel gas can be stably and assuredly supplied to the combustion chamber 2.

Third Exemplary Embodiment

Figure 7:
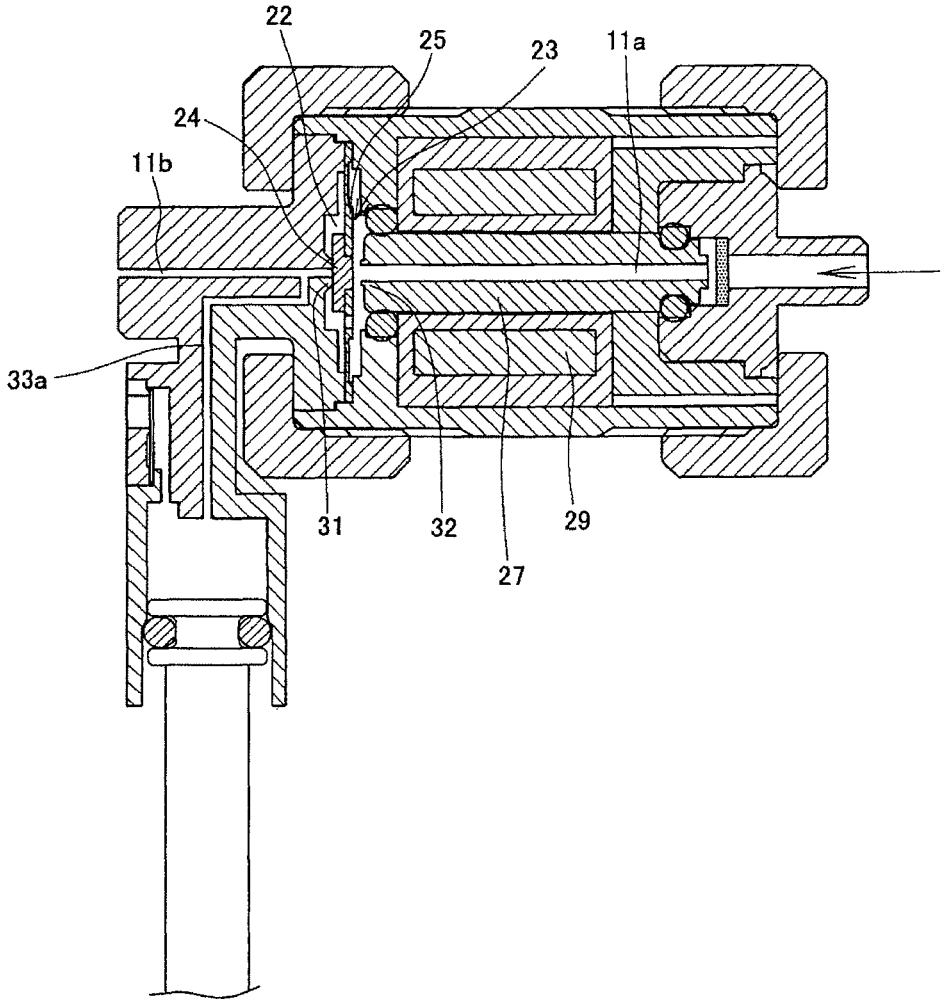
FIG. 7 is a sectional view of a fuel supply valve in a third exemplary embodiment.

FIG. 7 shows a third exemplary embodiment. A structure is substantially the same as that shown in FIG. 5. However, in the third exemplary embodiment, an air plunger 34 is not connected to a measuring chamber 22, and the air plunger 34 is connected to an intermediate part of a downstream side gas pipeline 11*b* communicating with a combustion chamber 2.

Figure 8:
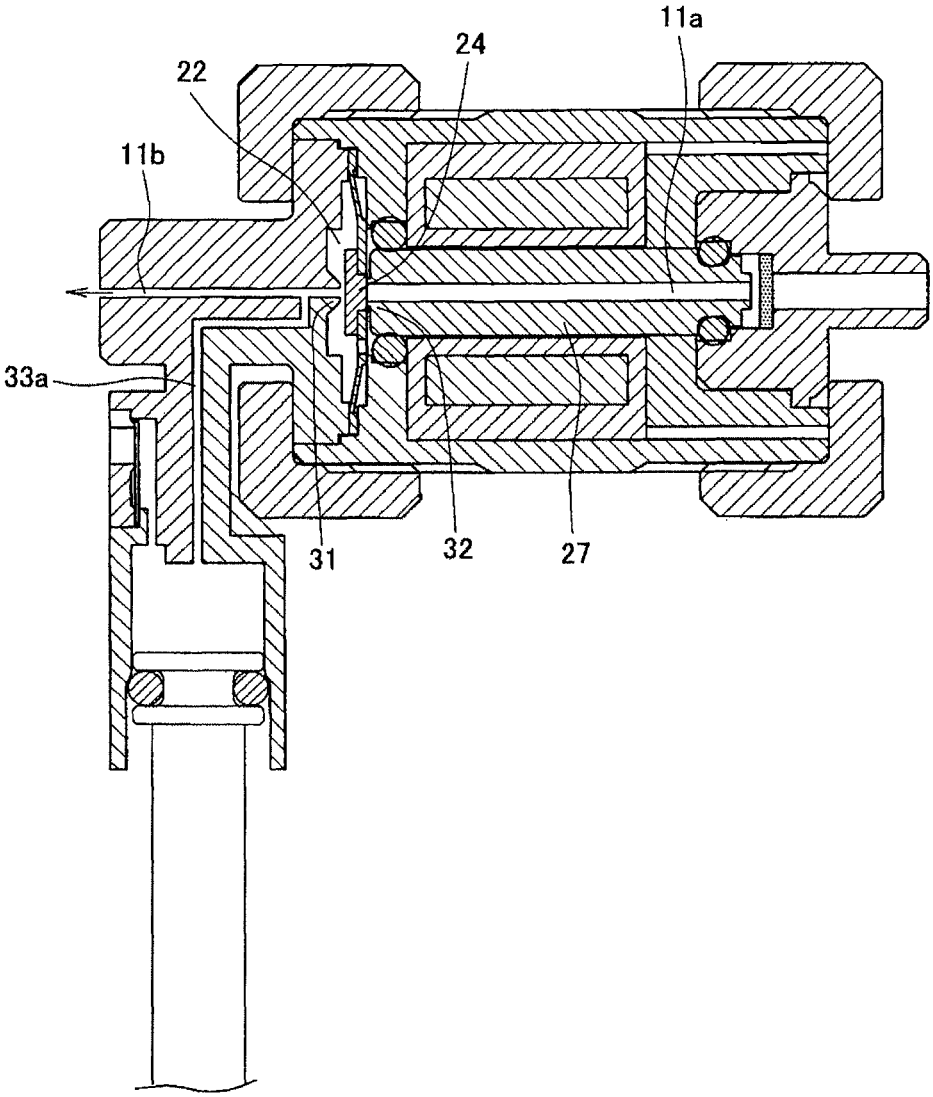
FIG. 8 is an explanatory view of a first half of an operating state for supplying fuel in the fuel supply valve.
Figure 9:
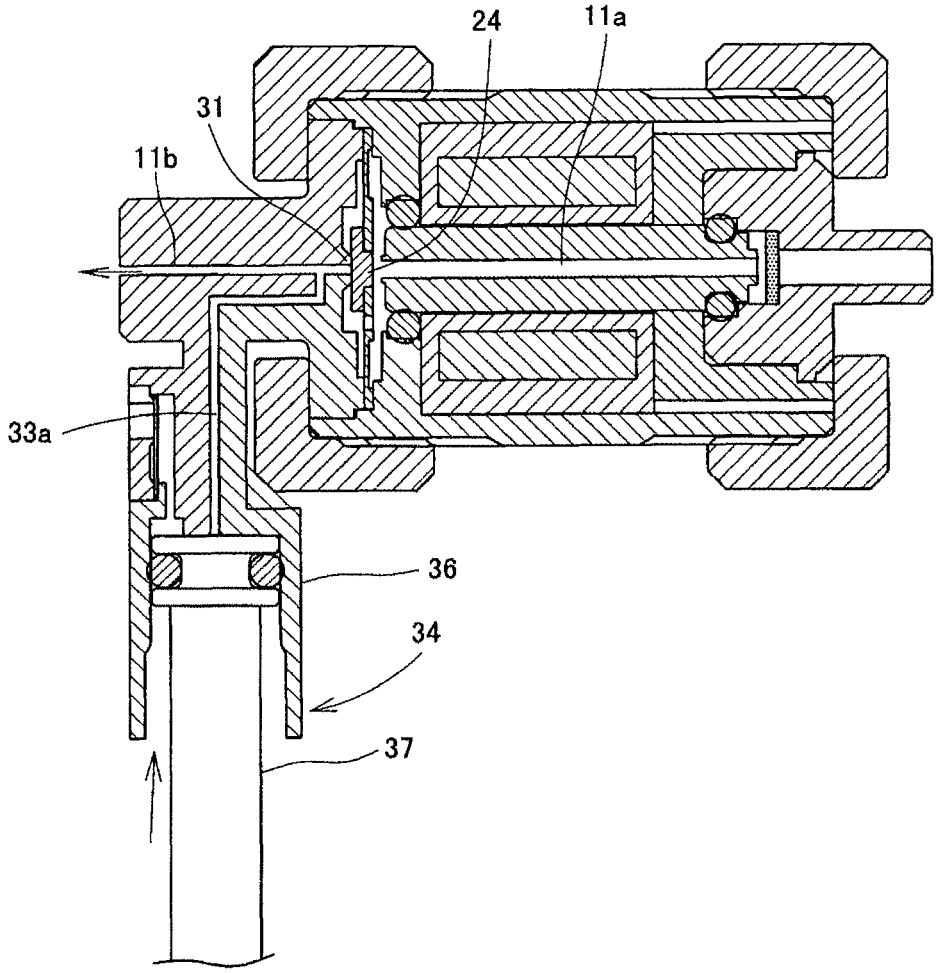
FIG. 9 is an explanatory view of the last half of an operating state for supplying fuel in the fuel supply valve.

According to the above-described structure, when an electric current is supplied to a coil 29, during a nail driving operation, to operate a valve main body 24, as shown in FIG. 8, the downstream side gas pipeline 11*b* and an air pipeline 33*a* are opened and an upstream side gas pipeline 11*a* is closed. Fuel gas in a measuring chamber 22 is supplied to the combustion chamber 2 through the downstream side gas pipeline 11*b* by a vaporizing pressure. Then, after a predetermined quantity of fuel gas is supplied, when the supply of the electric current to the coil 29 is released, as shown in FIG. 9, the valve main body 24 closes an opening end 31. Thus, the air plunger 34 is operated to compress air in a syringe 36 and supply the air to the air pipeline 33*a*. Since the air pipeline 33*a* is connected to the intermediate part of the downstream side gas pipeline 11*b* communicating with the combustion chamber 2, the fuel gas in the measuring chamber 22 is supplied to a part of the downstream side gas pipeline 11*b* connected to the air pipeline 33*a* by a vaporizing pressure and the air pressure of the compressed air from the air plunger 34 is applied to a further part of the downstream side gas pipeline 11*b* so that the fuel gas is powerfully jetted to the combustion chamber 2. Accordingly, the fuel gas can be stably and assuredly supplied to the combustion chamber 2.

The present invention is described in detail by referring to the specific exemplary embodiments, however, it is to be understood to a person with ordinary skill in the art that various changes or modifications may be made without departing from the spirit and scope of the present invention.

This application is based on Japanese Patent Application No. (2007-270396) filed on Oct. 17, 2007 and contents thereof are incorporated herein as a reference.

INDUSTRIAL APPLICABILITY

The present invention can be applied to a gas combustion type driving tool for supplying fuel gas from a gas canister attached to a tool main body to a combustion chamber.

The invention claimed is:

1. A gas combustion nail driving tool comprising:

a cylinder;

a piston slidably accommodated in the cylinder;

a driver that is integrally connected to the piston and drives a nail;

a movable sleeve that is arranged in an upper part of the cylinder and forms a combustion chamber;

a gas pipeline provided between a gas canister and the combustion chamber and having an upstream side gas pipeline and a downstream side gas pipeline;

a measuring chamber provided between the upstream side gas pipeline and the downstream side gas pipeline;

a solenoid valve provided in the measuring chamber; and an air supply device connected to the measuring chamber, wherein when fuel gas is supplied to the combustion chamber, the downstream side gas pipeline is opened and the upstream side gas pipeline is closed at the same time by the solenoid valve and compressed air is supplied to the measuring chamber from the air supply device so as to facilitate the fuel gas within the measuring chamber to jet to the combustion chamber, wherein the solenoid valve includes a coil and a core extending through the coil, and wherein the gas pipeline extends through the core.

2. A gas combustion nail driving tool comprising:

a gas pipeline provided between a gas canister and a combustion chamber and having an upstream side gas pipeline and a downstream side gas pipeline;

a measuring chamber provided between the upstream side gas pipeline and the downstream side gas pipeline;

a solenoid valve provided in the measuring chamber; and an air supply device connected to the measuring chamber, wherein when fuel gas is supplied to the combustion chamber, the downstream side gas pipeline is opened and the upstream side gas pipeline is closed at the same time by the solenoid valve and compressed air is supplied to the measuring chamber from the air supply device to supply the fuel gas within the measuring chamber to the combustion chamber, and wherein the air supply device supplies the air by interlocking with a contact member that is pushed by pressing an end of a driving tool main body to a workpiece and moves relative to the driving tool main body.

3. The gas combustion nail driving tool according to claim 2, wherein the solenoid valve includes a coil and a core extending through the coil, and wherein the gas pipeline extends through the core.

* * * * *